US011549318B2

(12) United States Patent
Hinshaw et al.

(10) Patent No.: US 11,549,318 B2
(45) Date of Patent: Jan. 10, 2023

(54) CABLE PUSHER AND RELATED METHODS

(71) Applicant: J.H. FLETCHER & CO., Huntington, WV (US)

(72) Inventors: Gregory E. Hinshaw, Proctorville, OH (US); Bill Kyslinger, Culloden, WV (US); Jaco Steyn, Delmas (ZA)

(73) Assignee: J.H. FLETCHER & CO., Huntington, WV (US)

( * ) Notice: Subject to any disclaimer, the term of this patent is extended or adjusted under 35 U.S.C. 154(b) by 44 days.

(21) Appl. No.: 16/722,631

(22) Filed: Dec. 20, 2019

(65) Prior Publication Data

US 2020/0199947 A1 Jun. 25, 2020

Related U.S. Application Data

(60) Provisional application No. 62/783,280, filed on Dec. 21, 2018.

(51) Int. Cl.
*E21B 19/08* (2006.01)

(52) U.S. Cl.
CPC ..... *E21B 19/08* (2013.01)

(58) Field of Classification Search
CPC ..... E21B 19/08; E21D 21/006; E21D 20/00; E21D 20/003; B65H 51/18
USPC ..... 166/77.51
See application file for complete search history.

(56) References Cited

U.S. PATENT DOCUMENTS 2,748,870 A 6/1956 Basha
3,734,211 A 5/1973 Haisch et al.
4,085,492 A 4/1978 Stange
4,710,065 A 12/1987 Leppanen
5,460,073 A * 10/1995 Preston ..... E21C 37/14 86/20.15

(Continued)

FOREIGN PATENT DOCUMENTS

CA 1218532 A 3/1987
DE 3410100 A1 10/1984

(Continued)

OTHER PUBLICATIONS

English Abstract of EA029885B1 dated May 31, 2018.

(Continued)

*Primary Examiner* — Matthew Troutman
*Assistant Examiner* — Patrick F Lambe
(74) *Attorney, Agent, or Firm* — Dickinson Wright PLLC; Andrew D. Dorisio

(57) ABSTRACT

An apparatus serves to grip a cable for delivery into a borehole in a surface of a mine passage in connection with an actuator, such as a drill mast having a carriage capable of being advanced and retracted along the drill mast. A pusher is formed from a pair of jaws for engaging the cable. The jaws may be biased toward a first position for engaging the cable during an advance of the carriage, and automatically movable to a second position for releasing from engagement with the cable during a retraction of the carriage. The pusher may be pivotally mounted to a carriage capable of being advanced and retracted along a drill mast, which movement may cause the jaws to self-actuate for engaging and advancing the cable during an upstroke and release therefrom during a downstroke. Related methods are also disclosed.

25 Claims, 10 Drawing Sheets

(56) References Cited

U.S. PATENT DOCUMENTS

| | | | | |
|---|---|---|---|---|
| 6,030,151 | A * | 2/2000 | Woolnough | E21D 20/003 405/302.2 |
| 6,076,236 | A * | 6/2000 | DeFrance | F16G 11/048 294/102.1 |
| 8,727,669 | B2 * | 5/2014 | Eddowes | B65H 51/10 226/188 |
| 2010/0126747 | A1 | 5/2010 | Galler | |
| 2013/0074756 | A1 | 3/2013 | Moreau | |
| 2015/0259984 | A1 | 9/2015 | Taggart et al. | |
| 2015/0275667 | A1 | 10/2015 | Comorge et al. | |
| 2018/0010454 | A1 | 1/2018 | Holdsworth et al. | |

FOREIGN PATENT DOCUMENTS

| | | | |
|---|---|---|---|
| EA | 029885 | B1 | 5/2018 |
| GB | 2303897 | A | 3/1997 |
| GB | 2484166 | A | 4/2012 |
| RU | 2580669 | C2 | 4/2016 |
| SU | 562643 | A1 | 6/1977 |
| SU | 642472 | A1 | 1/1979 |
| SU | 876975 | A1 | 10/1981 |
| SU | 899878 | A1 * | 1/1982 |
| SU | 899878 | A1 | 1/1982 |
| SU | 1157215 | A1 | 5/1985 |
| WO | 2014140609 | A2 | 9/2014 |

OTHER PUBLICATIONS

English Description of SU8988978A1 dated Jan. 23, 1982.
English Abstract of SU1157215A1 dated May 23, 1985.
English Description of SU876975A1 dated Oct. 30, 1981.
English Description of SU562643A1 dated Jun. 25, 1977.
English Description of SU642472A1 dated Jan. 15, 1979.

* cited by examiner

CABLE PUSHER AND RELATED METHODS

This application claims the benefit of U.S. Provisional Patent Application Ser. No. 62/783,280, filed Dec. 21, 2018, the disclosure of which is incorporated herein by reference.

TECHNICAL FIELD

This disclosure is directed to the anchoring arts and, in particular, to a cable pusher and related methods.

BACKGROUND

In the course of providing anchorage in an underground mine passage, such as for the roof or rib, difficulties often arise when attempting to insert a wire rope, conduit, or other type of flexible anchor (hereinafter collectively referred to as a "cable") into a borehole in a rock formation. In order to aid in securing the cable in the borehole, fast setting chemical resins are typically used, which dramatically increase the resistance to insertion. This problem is further enhanced by the fact that the annulus between the cable and the opening is small, which makes properly aligning the cable a challenge.

Known past proposals for cable insertion employ powered devices in the form of clamps or roller mechanisms as means of facilitating the insertion of the cable into a hole. Such devices are complex and can be costly to manufacture. Moreover, the devices have proved exceedingly difficult to effectively operate and maintain in the field.

Accordingly, the present disclosure proposes a pusher for gripping and pushing a cable into a borehole in a rock formation. The cable pusher would be simple in construction and easy to manufacture and maintain. The pusher would also be easy and intuitive to use, and would be able to successfully push a cable in boreholes having a narrow annulus and/or with pre-inserted resin.

SUMMARY

According to one aspect of the disclosure, a cable pusher is provided. The cable pusher may be located adjacent to a borehole, and adapted for being moved toward and away from the borehole, such as in connection with an actuator, such as for example a drilling rig or mast with a reciprocating carriage to which the pusher is attached. The pusher may be adapted to self-clamp onto the cable in a passive manner, such as by using a clamp formed by a pair of jaws operable without the use of power. The self-clamping process occurs as the jaws are moved toward the borehole, thus gripping and pushing the cable, and then automatically releasing when the jaws are moved away from the borehole, thus serving to reliably and automatically advance the cable during each cycle (without the need for operator intervention except as may be necessary to load the cable or attach it to a drill head).

In one embodiment, the jaws are mounted in opposition at an acute angle relative to a longitudinal axis of the cable. A spring is provided for biasing each jaw to grip the cable, at least during an advance of an associated actuator, such as a drill mast with which the cable pusher may be associated in use. The angle of the jaws induces an additional clamping force proportional to the force used to push the cable into a drilled hole by pushing on the clamp, but releases during the return stroke so that the cable is not withdrawn a corresponding amount (and thus "one way" insertion is achieved).

The clamp further includes a lateral opening, so that the cable can be inserted or removed along the length of the cable to a location between the jaws. This configuration enables the cable to be inserted into the hole before inserting it into the clamp, and allows for a proximal end portion of the cable (which may include an oversized driving head) to be removed from the clamp once installed. The clamp may include a retainer for retaining the cable in the clamp, so it does not inadvertently exit the lateral opening.

The clamp may be mounted to a drill feed carriage on a lateral slide that simultaneously moves the drill unit from alignment with the drilled hole and aligns or nearly aligns the clamp with the drilled hole. The clamp may also be mounted on a pivot so it can move or swing from a position in line with the drilled hole to follow the shape of the cable when it is not straight.

BRIEF DESCRIPTION OF THE DRAWING FIGURES

The accompanying drawings incorporated in and forming a part of the specification, illustrate several aspects of this disclosure, and together with the description serve to explain the principles of the disclosure. In the drawings.

DETAILED DESCRIPTION

Figure 1:
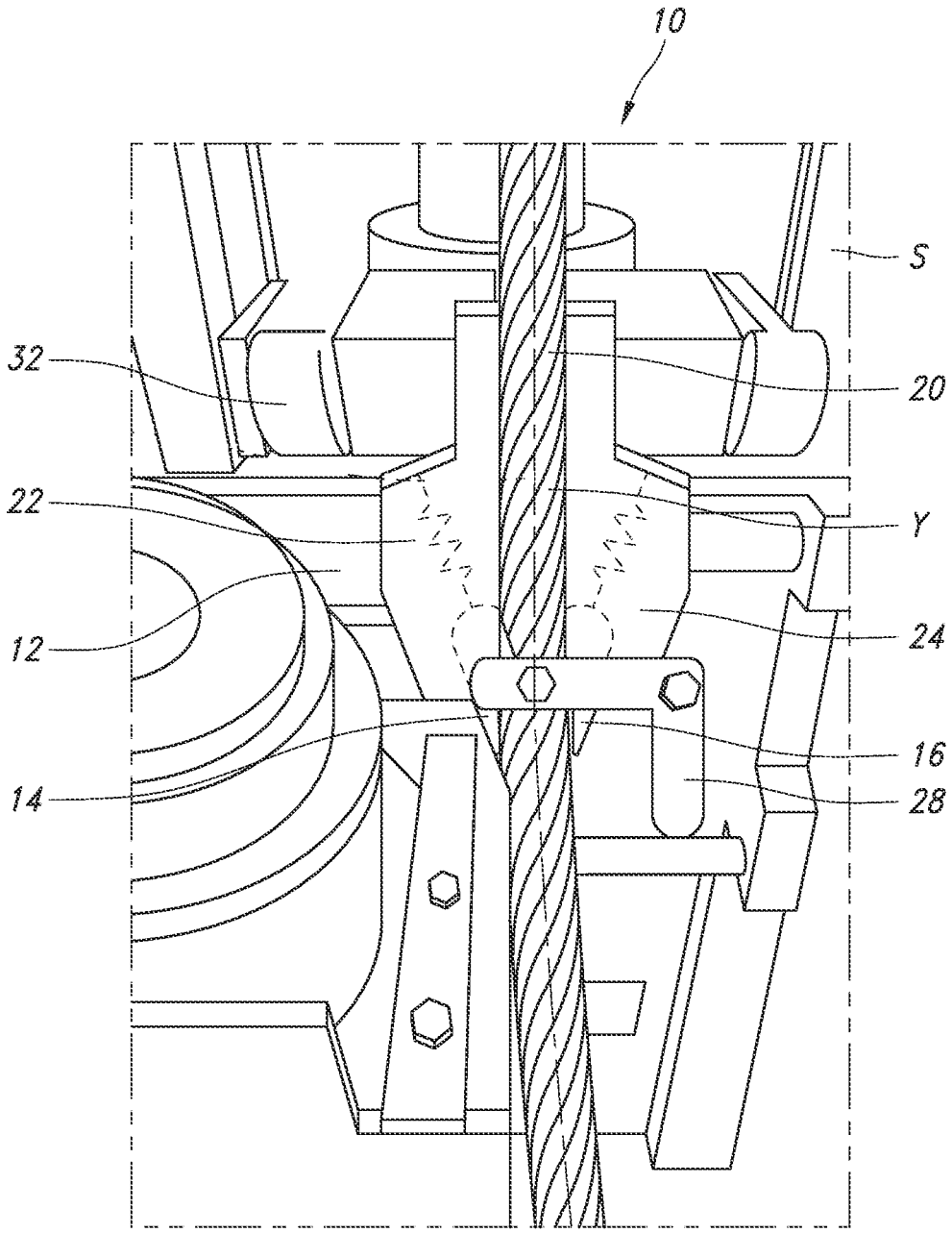
FIG. 1 is a partially cutaway front view of one embodiment of the cable pusher in use.
Figure 3:
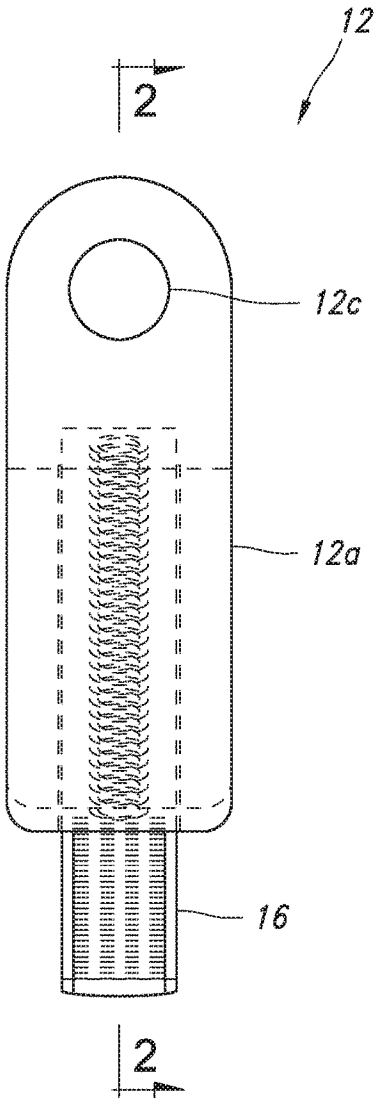
FIG. 3 is a side view of the cable pusher.

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized, and that process or other changes may be made without departing from the scope of the disclosure. The following detailed description is not to be taken in a limiting sense, and the scope of the invention is defined only by the appended claims and their equivalents.

Referring to FIGS. 1, 2, 3, and 4, a cable pusher 10 is provided. The cable pusher 10 may be used to insert a cable 20 into a borehole, such as in a surface of a mine passage (such as, for example the roof). In the illustrated embodiment, the cable pusher 10 includes a clamp 12, comprised of a housing 12*a* having bores 12*b* for receiving a pair of independently movable jaws 14, 16. As a result of the relative orientation of the bores 12*b*, the jaws 14, 16 are arranged at opposing angles from longitudinal the axis Y of a passage P for receiving the cable 20. In the illustrated embodiment, the axis X along which the jaws 14, 16 travel forms an acute angle α, which may be approximately 15 degrees relative to the axis Y, but the value could vary depending on the particular application.

The jaws 14, 16 each include engagement faces 14*a*, 16*a* for engaging the cable 20. These faces 14*a*, 16*a* may be arranged to be generally parallel to the axis Y at all times, despite the angular mounting of the jaws 14, 16. The faces 14*a*, 16*a* may also be frictionally enhanced, such as by including horizontal grooves, knurling, or the like, to create a strong, but releasable, gripping force on the relatively smooth outer surface of the cable 20 (which is typically made of braided steel wire).

Figure 2:
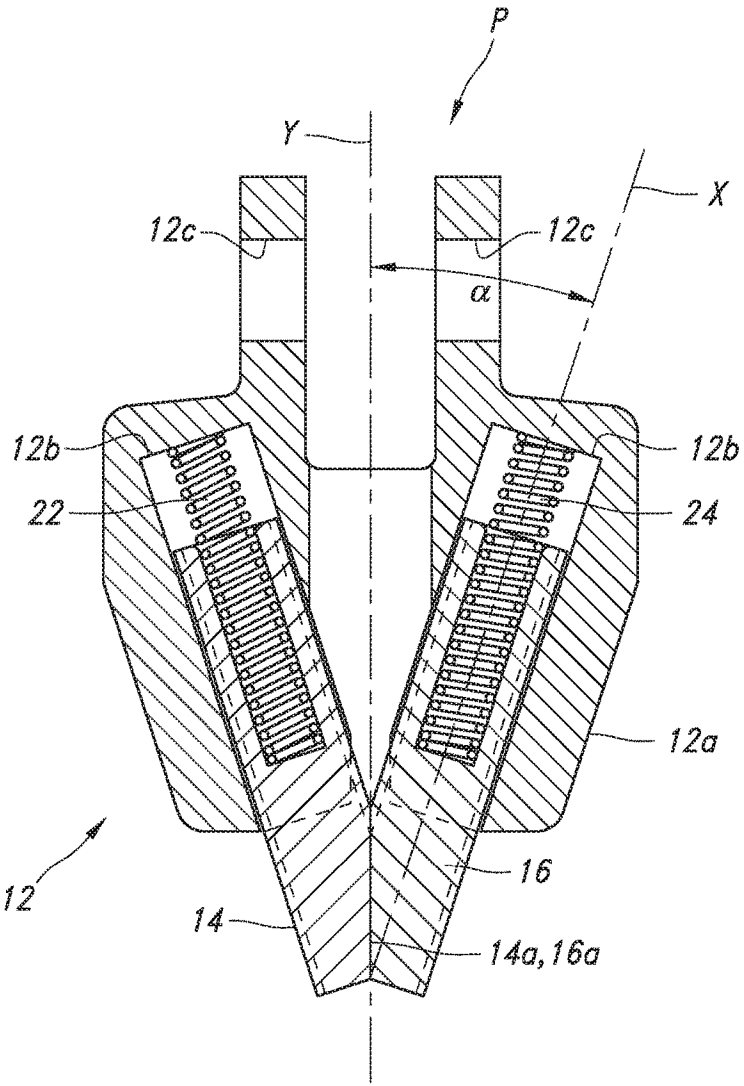
FIG. 2 is a cross-sectional front view of the cable pusher taken along line 2-2 of FIG. 3 in a closed state.
Figure 4A:
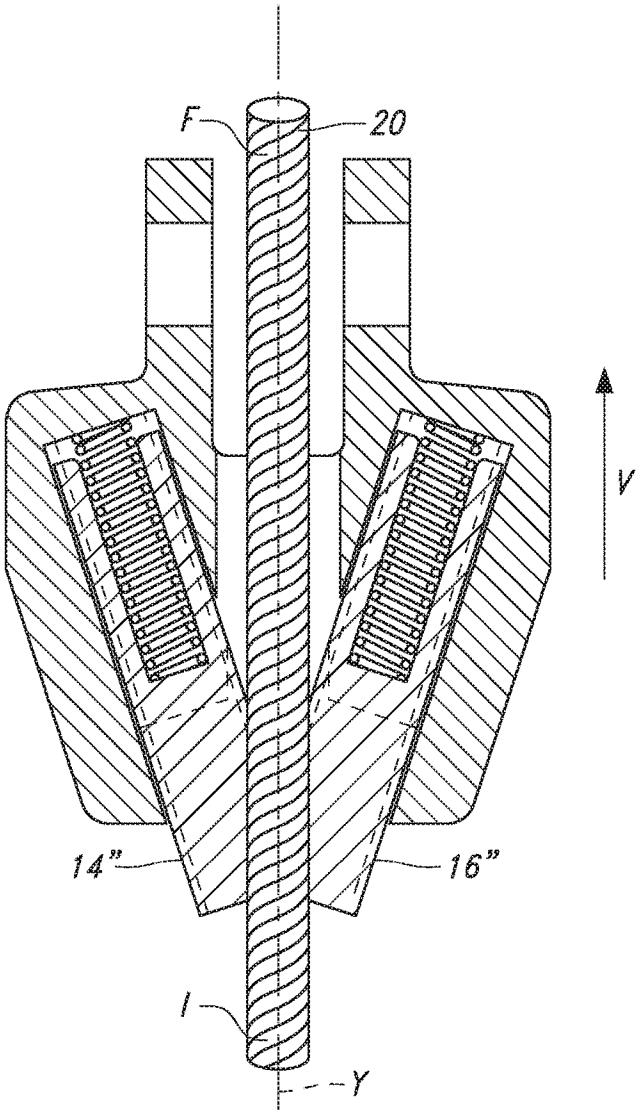
FIGS. 4A and 4B are cross-sectional views showing the possible movement of the jaws between a first position for gripping the cable during an upstroke of an associated actuator and a second position for releasing from gripping the cable during a downstroke of the associated actuator.
Figure 4:
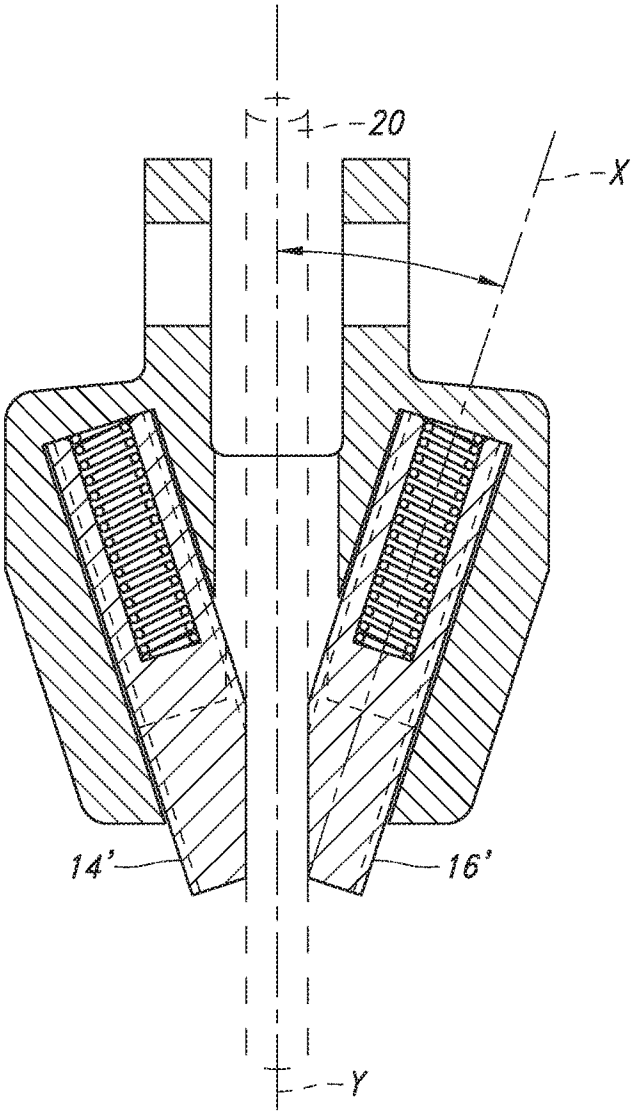
FIG. 4 is a cross-sectional front view of the cable pusher in an open state.

As a result of the adaptation provided, the jaws 14, 16 are independently movable toward and away from a centerline of the pusher 10, such as between a first or closed position for gripping the cable 20, and a second or open position (14', 16') for releasing the cable, as can be understood from comparing FIGS. 2 and 4. The jaws 14, 16 may be normally biased toward the first or closed position, and thus when in the second position, are constantly forced along the axis X to engage the cable 20 aligned with axis Y. The biasing force may be provided by one or more springs 22, 24, such as coil springs associated with the housing 12*a*, such as by being recessed within the bores 12*b* and also recessed within the upper portions of the jaws 14, 16. The springs 22, 24 are arranged to normally urge the jaws 14, 16 along the axis X and toward the axis Y, with a spring constant selected to ensure a proper gripping force against the cable 20 (the nature of which may vary) and yet one that can be overcome to allow for release when desired, as outlined further in the following description. While two springs are shown, it can be appreciated that biasing only one jaw 22 or 24 is possible.

As can be appreciated, the passage P is also open along one side, such as the front lateral side in use. This allows for the cable 20 to be inserted or removed from a position between the jaws 14, 16. A movable retainer 28 may also be provided to retain the cable 20 in pusher 10 in a deployed position, but allow for the easy removal when desired.

Figure 5:
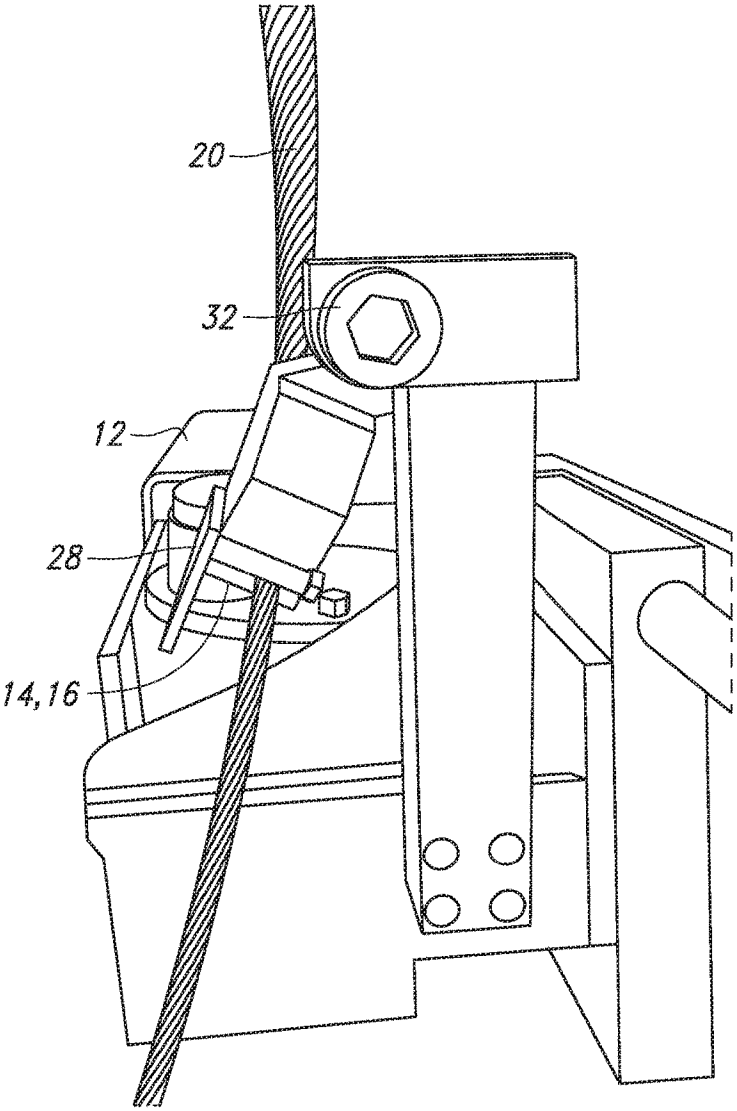
FIG. 5 is a side view illustrating the cable pusher in use, and showing in particular the pivoting mounting.

As depicted in FIG. 5, the pusher 10 may be mounted to swing from a position in line with an axis of the borehole to accommodate the shape of the cable 20 when it is not straight, or is being advanced at an angle relative to the borehole axis. This figure shows the pusher 10 in a pivoted position resulting from its engagement of a curved portion of cable 20. With combined reference to FIGS. 2 and 5, it can be understood that, in order to achieve this pivoting movement, the housing 12*a* may include a yoke with apertures 12*c*, each for receiving a smooth shank of opposed bolts 32 carried by an associated support structure S (which may be adapted for moving to and fro to advance the cable, as outlined further in the following description).

Figure 8:
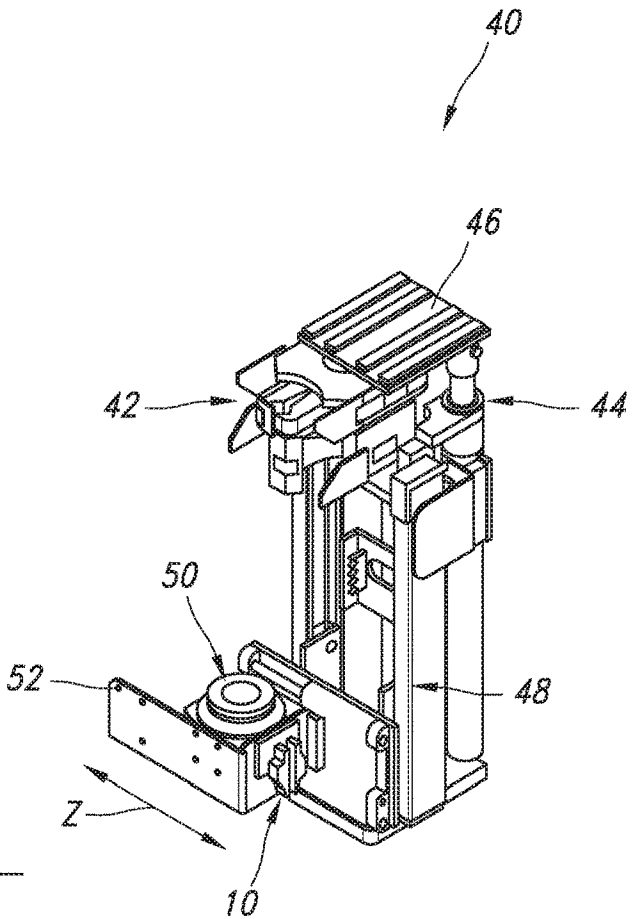
FIG. 8 is a perspective view of the drill mast of FIG. 7.
Figure 7:
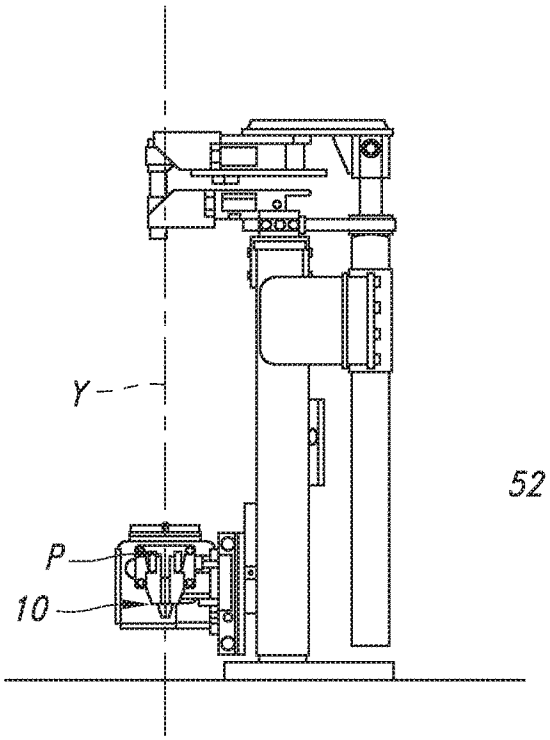
FIG. 7 is a side view of the drill mast in a retracted condition.
Figure 6:
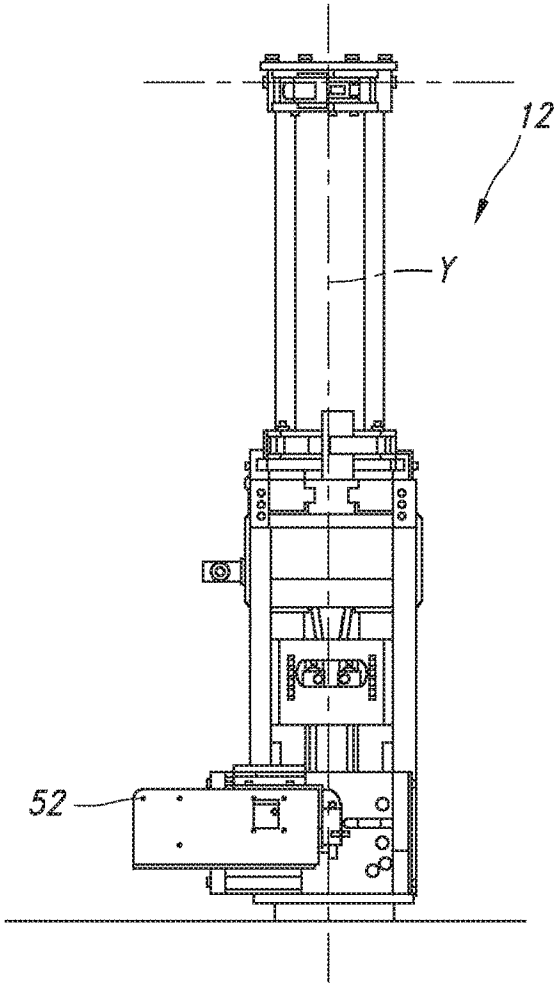
FIG. 6 is a front view of a drill mast in an extended condition.

With reference to FIGS. 6, 7, and 8, the cable pusher 10 may be used in conjunction with a drilling mast 40 for forming a borehole in the surface of an underground mine passage. The mast 40 may comprise a drill guide 42 for guiding a drill, as well as an actuator, such as a hydraulic cylinder 44, for advancing a support 46 for temporarily engaging the surface of the mine passage into which the borehole is formed. An actuator 48 may also be used to advance and retract an associated drill head 50 along the mast 40 for using a drilling element (steel) to form the borehole. The cable pusher 10 may be mounted to the mast 40 via a carriage 52 mounted for lateral movement (note arrow Z). The carriage 52 may thus move to and fro to reposition the drill head 50 from alignment with the axis of the drilled hole and align the pusher 10 with the drilled hole (so that the axis of the drilled hole is generally coincident with axis Y), and then back again.

Figure 4B:
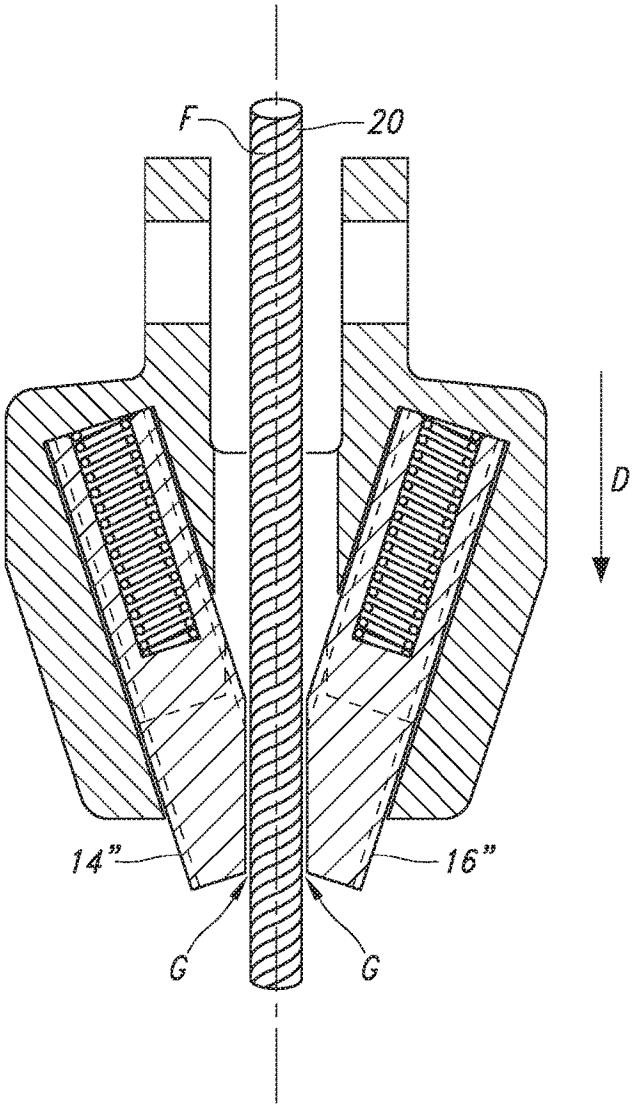

In operation, once the borehole is formed (drilled) by a drill using the drill head 50 and installation of the cable is desired, the pusher 10 is moved laterally into alignment with the borehole (which may be done manually or automatically). A distal end portion of the cable 20 is then inserted into the borehole, and a proximal end portion is passed into the passage P and then secured in place using the retainer 28. During the upward movement (action arrow A in FIG. 4A) resulting from an advance stroke of the carriage 52, it can be appreciated that the jaws 14, 16 are forced against the cable 20, and thus provide a clamping force to engage and move it farther into the borehole. The biasing force of the springs 22, 24 may be such that the jaws 14, 16 do not fully reach the bottom of the associated bores when the cable 20 is adequately gripped (note intermediate position of jaws 14", 16" in FIG. 4B).

Once the maximum advance is reached during an upstroke (compare initial position I in FIG. 4A with final position F in FIG. 4B, reflecting the advance of the cable 20 a distance corresponding to the length of the actuator stroke), the feed may retracted to reverse the movement of the carriage 52. As can be appreciated, during the downward movement or retraction (arrow D in FIG. 4B), the springs 22, 24 may more fully or completely compress to release the gripping force, and the jaws 14, 16 thus slide along the cable 20 without gripping and retracting it (note gap G, which is exaggerated for purposes of illustration of the concept). Once the bottom of the stroke is reached, the feed may be reversed, at which point the jaws 14, 16 are biased to fully engage a proximal portion of the cable 20 and advance it into the borehole. As can be appreciated, the operation may be repeated as necessary or desired to advance the cable into the borehole.

Figure 9:
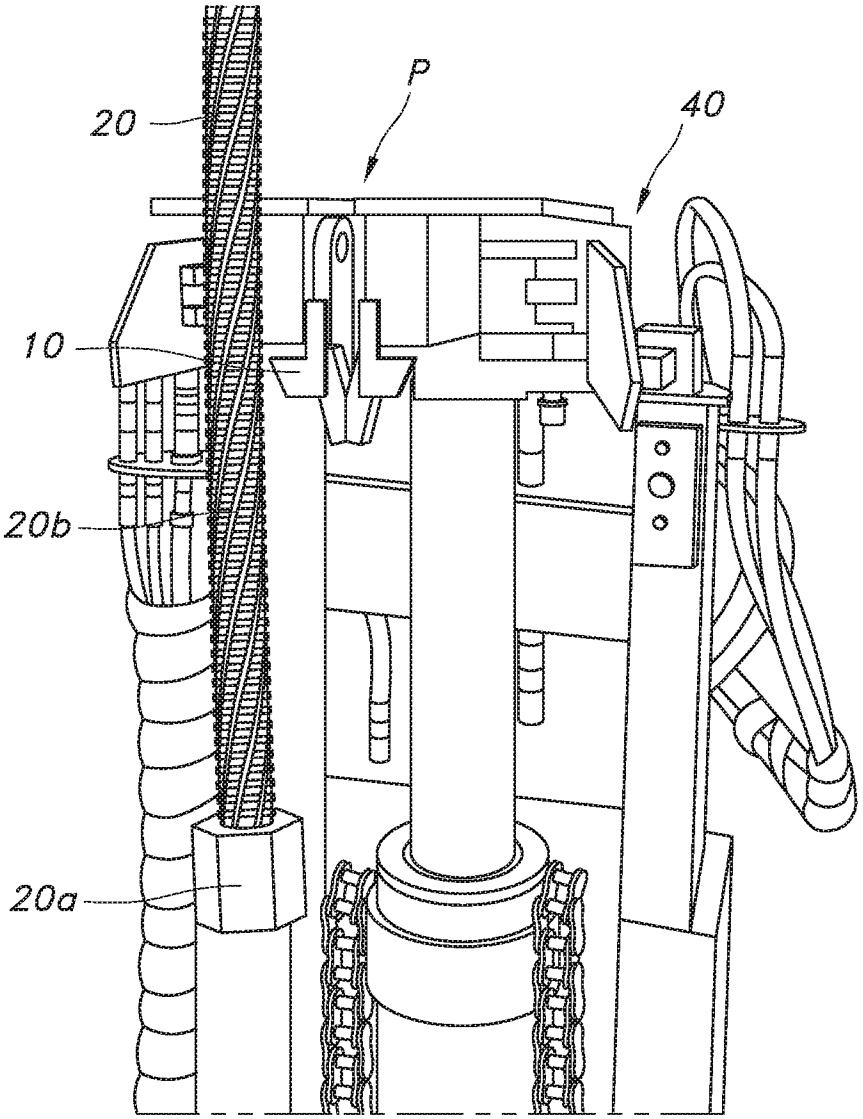
FIG. 9 is a front view of the pusher associated with a drill mast, and illustrating one particular version of a cable for use in connection with the disclosed pusher.
Figure 11:
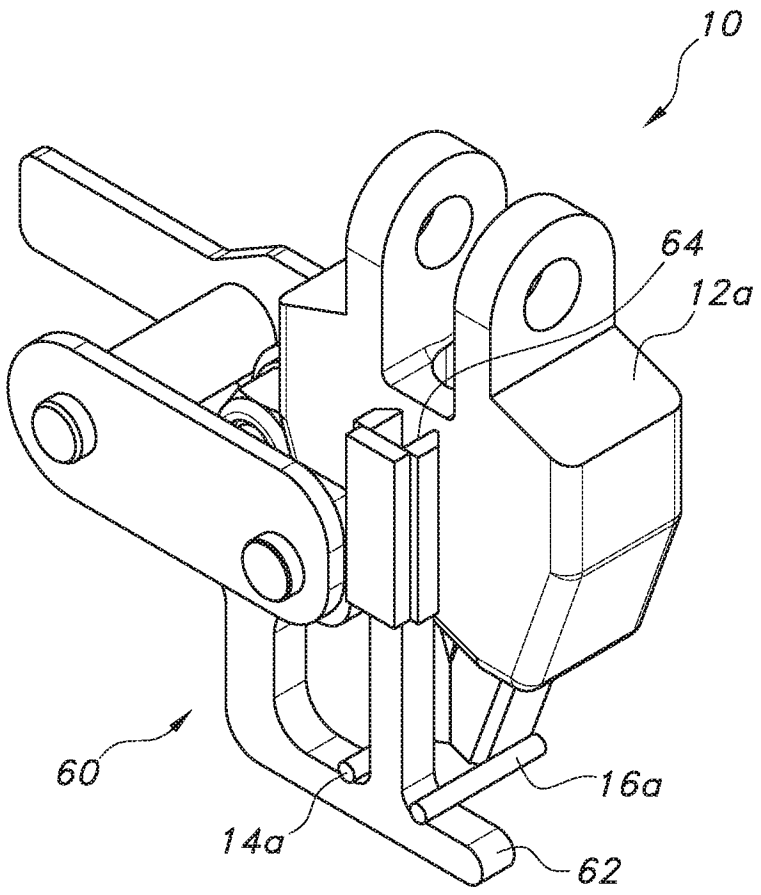
FIGS. 10-13 illustrate an optional retainer for maintaining the cable pusher in an open condition, such as for loading the cable therein.
Figure 10:
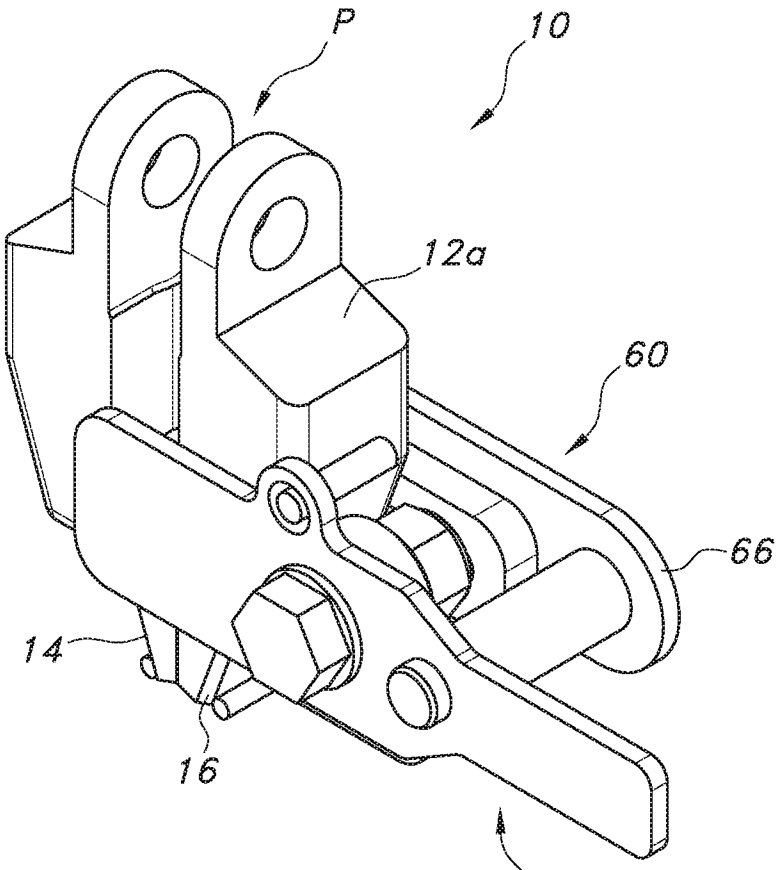

The cable 20 may include a pre-installed driving head 20*a* at a proximal end thereof, as shown in FIG. 9. As this head 20*a* is oversized relative to the passage P and typically would not fit therethrough, it can be appreciated that the open nature of the design of pusher 10 allows for the cable 20 to be withdrawn from the passage P once fully installed. The driving head 20*a* (if present) may then be associated with the drill head 50 and the installation completed by rotating/driving the cable 20 the remainder of the way into the borehole (with the cured resin then providing the desired securing function to provide support for the mine passage). As indicated in FIG. 9, the cable 20 may also be provided with surface notches 20*b* running transverse or generally circumferentially, which serve to enhance the gripping force established with the jaws 14, 16.

FIGS. 10-13 illustrate a version of the retainer 28 adapted to maintain the cable pusher in an open condition, such as for loading the cable therein. As noted above, the retainer 28 may be mounted for pivoting movement for covering the passage P, and may be connected to an support 60 for supporting the jaws 14, 16 in an open condition. Specifically, each jaw 14, 16 may be provided with a projection 14*a*, 16*a*, which is engaged by a depending portion of the support 60 in the form of an inverted T-shaped member 62. The T-shaped member 62 is partly inserted into a channel 64 formed in the housing 12*a* in sliding engagement, and a linkage 66 connects the member 62 for causing up and down movement relative to the pusher 10.

Figure 13:
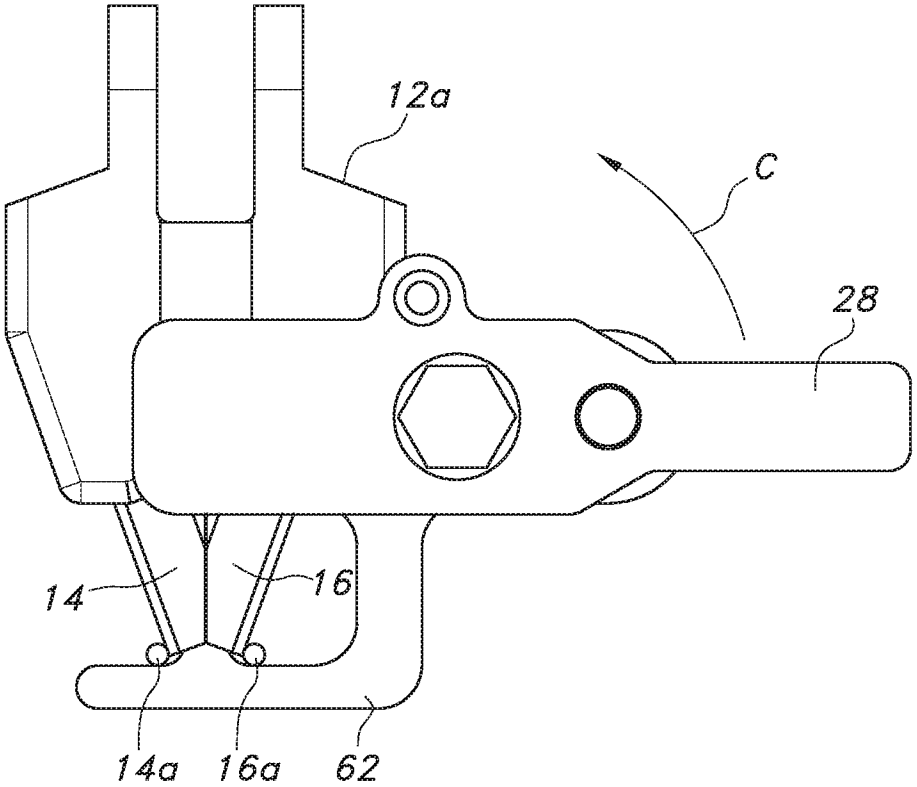
Figure 12:
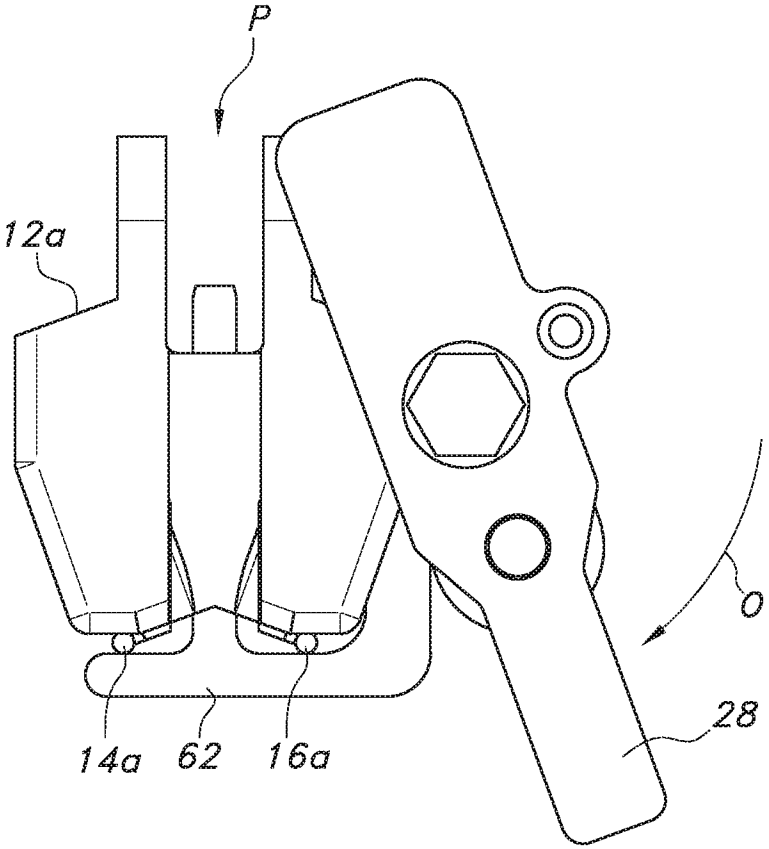

As perhaps best understood from FIGS. 12 and 13, the retainer 28 in the open position (arrow O) raises the T-shaped member 62, which in turn engages the projections 14*a*, 16*a* of the jaws 14, 16. This overcomes the biasing force and maintains the jaws 14, 16 in an open condition to allow for a cable to be inserted into passage P. Closing the retainer 28 (arrow C) allows the jaws 14, 16 to then close (fully as shown, but of course in gripping engagement with a cable, if present). Loading and unloading of the cable is thus greatly facilitated.

Figure 14:
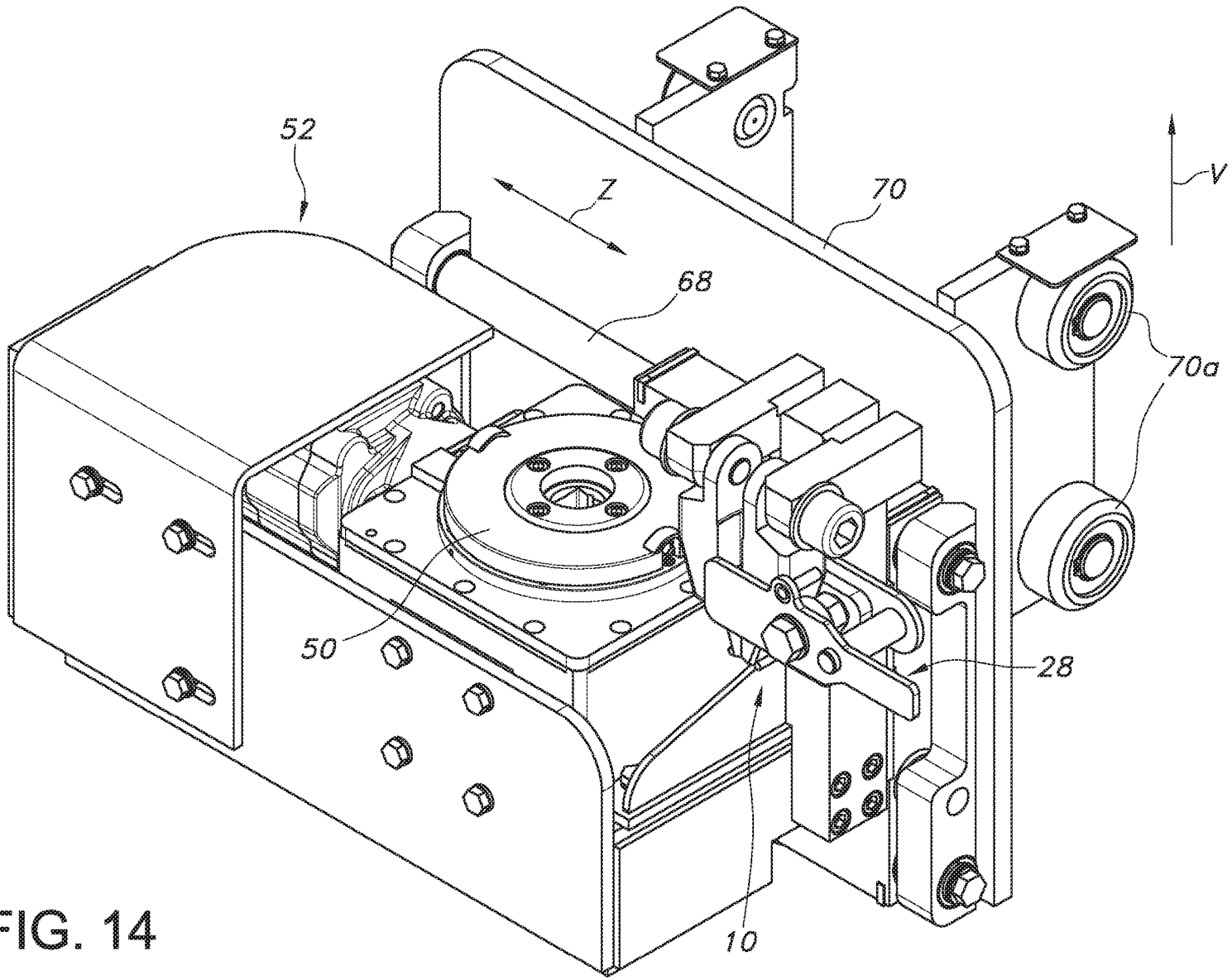
FIG. 14 illustrates the movable nature of a carriage for supporting the pusher and a drill head.

FIG. 14 illustrates the carriage 52 for the drill head 50 mounted for lateral movement (note arrow Z). As noted above, the carriage 52 may thus move to and fro to move the drill head 50 from alignment with the axis of the drilled hole and align the pusher 10 (shown with the optional retainer 28) with the drilled hole (so that the axis of the drilled hole is generally coincident with axis Y), and then back again. This may be achieved by mounting the carriage 52 on generally parallel, horizontal guides 68 (only upper one shown), such as for providing sliding movement. The provision of wheels 70*a* on the carriage support 70 for traversing the mast 40 in the vertical direction V is also noted.

Figure 15:
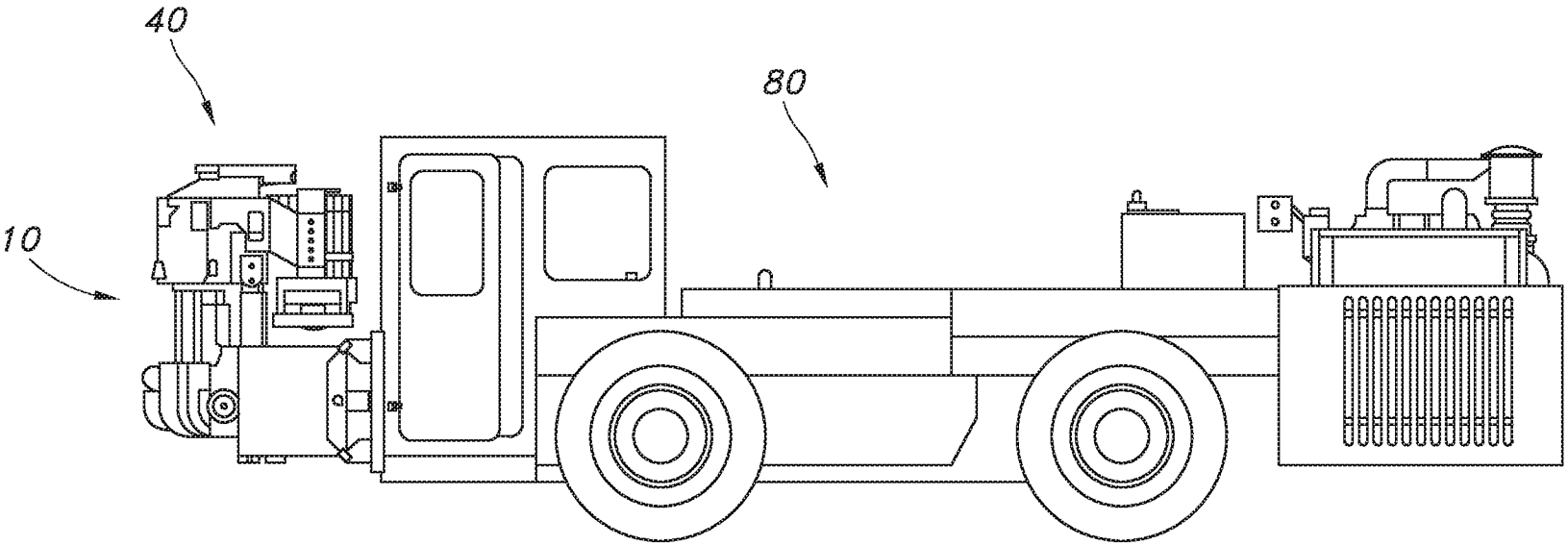
FIG. 15 is a side view of a vehicle which may include the cable pusher.

As illustrated in FIG. 15, the cable pusher 10 may be associated with a vehicle 80, which may include the mast 40. This allows for the cable pusher 10 to traverse about a mine passage or other location where anchorage is needed. While a vehicle 80 with wheels is shown, it can be appreciated that any type of ground-engaging arrangement for causing movement, such as crawler tracks, may be used. As can be appreciated, the pusher 10 may also be used independent of a vehicle as well, or in connection with other forms of mine machinery.

This disclosure may be considered to pertain to any one or more of the following items, whether considered alone or in any combination:

1. An apparatus for pushing a cable into a borehole in a surface of a mine passage in connection with an actuator, such as for example a drill mast having a carriage capable of being advanced and retracted along the drill mast, comprising:

a pusher comprising a pair of jaws for engaging the cable, the pair of jaws being biased toward a first position for engaging the cable during an advance of the carriage, and automatically movable to a second position for releasing from engagement with the cable during a retraction of the carriage.

2. The apparatus of item 1, wherein each of the jaws is biased along an axis extending at an acute angle relative to a longitudinal axis of a passage in the pusher for receiving a portion of the cable.

3. The apparatus of item 1 or item 2, wherein the pusher includes a housing, and each jaw is located within a bore in the housing.

4. The apparatus of item 3, wherein the bore includes a spring for biasing the jaw.

5. The apparatus of any of items 1-4, wherein each jaw includes a face for engaging the cable, the face being generally parallel with a longitudinal axis of the passage.

6. The apparatus of any of items 1-5, wherein the pusher is adapted for pivotally mounting to the carriage.

7. The apparatus of any of items 1-6, wherein the pusher includes a passage for receiving a portion of the cable.

8. The apparatus of item 7, wherein the passage includes a lateral opening for receiving the portion of the cable.

9. The apparatus of item 8, further including a retainer for retaining the portion of the cable within the passage.

10. An apparatus for pushing a cable into a borehole in a surface of a mine passage, comprising:

an actuator, such as a drill mast having a carriage capable of being advanced and retracted along the drill mast; and a pusher pivotally mounted to the carriage, the pusher comprising a pair of jaws for engaging the cable, the jaws being biased toward a first position for engaging the cable during an advance of the carriage, and automatically movable to a second position for releasing from engagement with the cable during a retraction of the carriage.

11. The apparatus of item 10, wherein the drill mast includes a drill head and is adapted for moving out of alignment with an axis of the borehole and moving the pusher into alignment with the axis of the borehole.

12. The apparatus of item 11, wherein the drill head is mounted to the carriage, which mounted for moving laterally relative to the drill mast.

13. An apparatus for pushing a cable into a borehole in a surface of a mine passage, comprising:

a drill mast having a carriage capable of being advanced and retracted along the drill mast, and also capable of moving to align a drill head with an axis of the borehole; and a pusher for pushing the cable into the borehole, the pusher connected to the drill carriage.

14. The apparatus of item 13, wherein the pusher comprises a pair of jaws for engaging the cable, the jaws being biased toward a first position for engaging the cable during the advance of the carriage, and automatically movable to a second position for releasing from engagement with the cable during the retraction of the carriage.

15. A method of inserting a cable into a borehole using a drilling mast, comprising:

gripping the cable using a pusher including a pair of opposed jaws during an advance portion of a stroke of the drilling mast; and releasing the jaws from gripping the cable during a return portion of the drilling mast stroke.

16. The method of item 15, further including repeating the gripping step on a proximal portion of the cable.

17. The method of item 15 or item 16, further including the step of retaining a portion of the cable in a laterally open passage of the pusher including the pair of opposed jaws.

18. The method of any of items 15-17, wherein the cable includes a driving head, and further including the step of removing the cable from the laterally open passage before the driving head engages the pusher, and associating the driving head with a drill head.

19. The apparatus or method of any of the foregoing items, wherein the cable includes circumferential notches.

20. The apparatus or method of any of the foregoing items, further including a vehicle.

21. The apparatus or method of any of the foregoing items, further including means (such as a support) for retaining the pair of jaws in an open condition for loading the cable.

As used herein, the following terms have the following meanings:

"A", "an", and "the" as used herein refers to both singular and plural referents unless the context clearly dictates otherwise. By way of example, "a compartment" refers to one or more than one compartment.

"About," "substantially," or "approximately," as used herein referring to a measurable value, such as a parameter, an amount, a temporal duration, and the like, is meant to encompass variations of +/−20% or less, preferably +/−10% or less, more preferably +/−5% or less, even more 35 preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

The invention claimed is:

1. An apparatus for inserting a cable into a borehole in a surface of a mine passage in connection with an actuator capable of being advanced and retracted, comprising:

a pusher comprising a pair of jaws adapted to grip the cable during an advance of the actuator, and adapted to automatically release from engagement with the cable during a retraction of the actuator, wherein the pusher comprises a housing including a pair of bores, and wherein each jaw of the pair of jaws is adapted to slide within a respective one of the pair of bores.

2. The apparatus of claim 1, wherein at least one jaw of the pair of jaws is biased along an axis extending at an acute angle relative to a longitudinal axis of a passage in the pusher for receiving a portion of the cable.

3. The apparatus of claim 2, wherein the pusher includes a housing, and each jaw is located within a respective bore in the housing.

4. The apparatus of claim 1, wherein a spring is provided for biasing at least one jaw of the pair of jaws toward the cable.

5. The apparatus of claim 1, wherein each jaw of the pair of jaws includes a face for engaging the cable, the face being generally parallel with a longitudinal axis of the passage.

6. The apparatus of claim 1, wherein the pusher is pivotally mounted to the actuator.

7. The apparatus of claim 1, wherein the pusher includes a passage at least partially bounded by the jaws for receiving a portion of the cable.

8. The apparatus of claim 7, wherein the passage includes a lateral opening for receiving the portion of the cable.

9. The apparatus of claim 8, further including a retainer for retaining the portion of the cable within the passage.

10. The apparatus of claim 1, further including a support for retaining the pair of jaws in an open condition for loading the cable.

11. The apparatus of claim 1, wherein the actuator and the pusher are both adapted to move along a same axis during advancement and retraction.

12. An apparatus for pushing a cable into a borehole in a surface of a mine passage, comprising:

an actuator capable of being advanced and retracted relative to the surface; and a pusher pivotally mounted to the actuator, the pusher comprising a pair of jaws adapted to grip the cable during an advance of the actuator and release from engagement with the cable during a retraction of the actuator.

13. The apparatus of claim 12, wherein the pair of jaws adapted to move toward a first position for gripping the cable during the advance of the actuator and further adapted to automatically move to a second position for releasing from gripping the cable during the retraction of the actuator.

14. The apparatus of claim 12, wherein the actuator comprises a carriage connected to a drill mast.

15. The apparatus of claim 14, wherein the drill mast includes a drill head adapted for moving out of alignment with an axis of the borehole and moving the actuator into alignment with the axis of the borehole.

16. An apparatus for inserting a cable into a borehole in a surface of a mine passage, comprising:

a drill mast having a carriage capable of being advanced and retracted along the drill mast, the drill mast including a drill head selectively movable into and out of alignment an axis of the borehole, wherein the drill head is selectively moveable along an axis transverse to the axis of the borehole; and a pusher connected to the carriage for pushing the cable into the borehole along the borehole axis when the drill head is moved out of alignment therewith.

17. The apparatus of claim 16, wherein the pusher comprises a pair of jaws for engaging the cable, the jaws being biased toward a first position for engaging the cable during an advance of the carriage, and automatically movable to a second position for releasing from engagement with the cable during a retraction of the carriage.

18. The apparatus of claim 16, wherein the pusher is pivotally mounted to the carriage.

19. A method of inserting a cable into a borehole using an actuator, comprising:

gripping the cable using a pusher including a pair of opposed jaws during an advance portion of a stroke of the actuator, wherein during the gripping step, the opposed jaws are adapted to travel toward the cable along an axis extending at an acute angle relative to a longitudinal axis of a passage in the pusher for receiving a portion of the cable; and automatically releasing the jaws from gripping the cable during a return portion of the stroke, wherein during the automatically releasing step, the jaws are adapted to travel away from the cable along the axis extending at the acute angle relative to the longitudinal axis of the passage.

20. The method of claim 19, further including repeating the gripping step on a proximal portion of the cable after the releasing step.

21. The method of claim 19, further including the step of retaining a portion of the cable in a laterally open passage of the pusher including the pair of opposed jaws.

22. The method of claim 19, wherein the cable includes a driving head, and further including the step of removing the cable from the laterally open passage, and associating the driving head with a drill head of a drill mast.

23. An apparatus for inserting a cable into a borehole in a surface of a mine passage, comprising:

an actuator capable of being advanced toward and retracted away from the surface; and means for gripping the cable during an advance of the actuator and automatically releasing from engagement with the cable during a retraction of the actuator.

24. The apparatus of claim 23, wherein the means for gripping comprises a pusher comprising a pair of jaws adapted to grip the cable.

25. The apparatus of claim 24, wherein the pusher is pivotally mounted to the actuator.

* * * * *